US005531275A

United States Patent [19]

Sundholm

[11] Patent Number: 5,531,275

[45] Date of Patent: Jul. 2, 1996

[54] INSTALLATION FOR FIGHTING FIRE

[76] Inventor: Göran Sundholm, Ilmari Kiannon kuja 3, Fin-04310 Tuusula, Finland

[21] Appl. No.: 240,754

[22] PCT Filed: Nov. 25, 1992

[86] PCT No.: PCT/FI92/00316

§ 371 Date: May 20, 1994

§ 102(e) Date: May 20, 1994

[87] PCT Pub. No.: WO93/10860

PCT Pub. Date: Jun. 10, 1993

[30] Foreign Application Priority Data

Nov. 26, 1991 [FI] Finland ..... 915575
Nov. 29, 1991 [FI] Finland ..... 915669

[51] Int. Cl.[6] ..... A62C 35/58

[52] U.S. Cl. ..... 169/16; 169/19; 169/37; 169/38; 137/79; 137/504

[58] Field of Search ..... 169/13, 16, 17, 169/37, 38, 19, 5, 56, 60; 137/79, 625.48, 872, 504

[56] References Cited

U.S. PATENT DOCUMENTS 3,702,159 11/1972 Livingston ..... 169/5
3,703,930 11/1972 Lofstrand et al. ..... 169/16
3,884,304 5/1975 Messerschmidt et al. ..... 169/16
3,990,518 11/1976 Hemme ..... 169/16
4,359,097 11/1982 Claussen ..... 169/16
4,361,189 11/1982 Adams ..... 169/16
4,428,434 1/1984 Gelaude ..... 169/13

FOREIGN PATENT DOCUMENTS 93698 8/1978 Japan ..... 169/17
1474680 5/1977 United Kingdom .

*Primary Examiner*—Gary C. Hoge
*Attorney, Agent, or Firm*—Ladas & Parry

[57] ABSTRACT

An installation for fighting fire has, in one embodiment, first and second releasing devices for first and second groups of spray heads that overlap at border spray heads. The border spray heads are activatable by either of the first or second releasing devices and check valves at the border spray heads prevent extinguishing liquid from flowing from an activated one of the first or second groups of spray heads into the other. In a second embodiment, one spray head distributes extinguishing liquid to other spray heads.

9 Claims, 6 Drawing Sheets

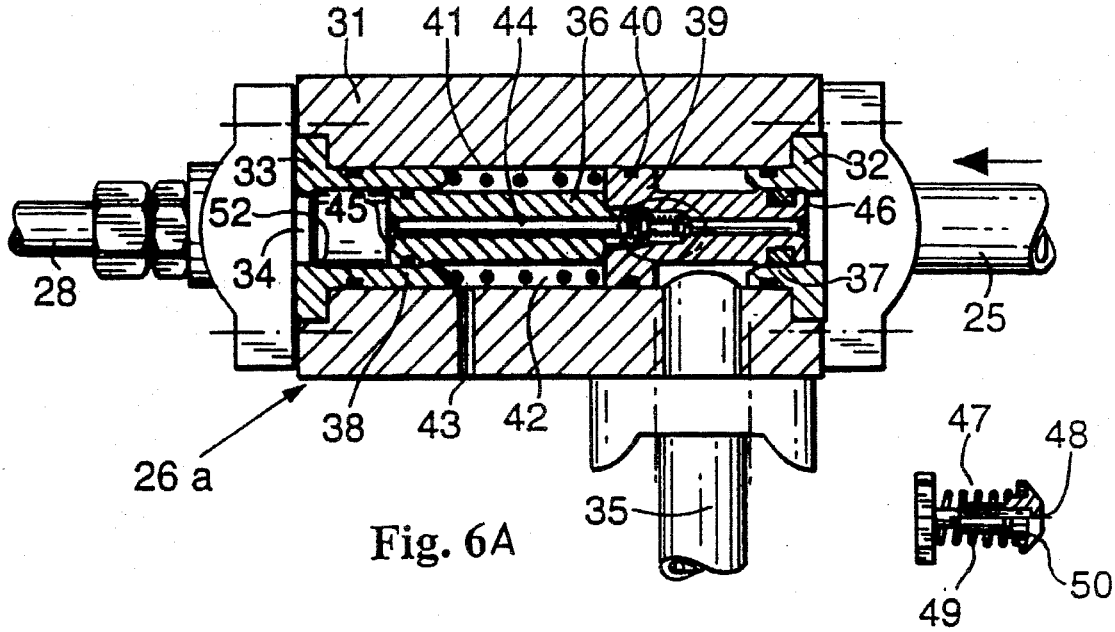
Fig. 6A
Fig. 6B
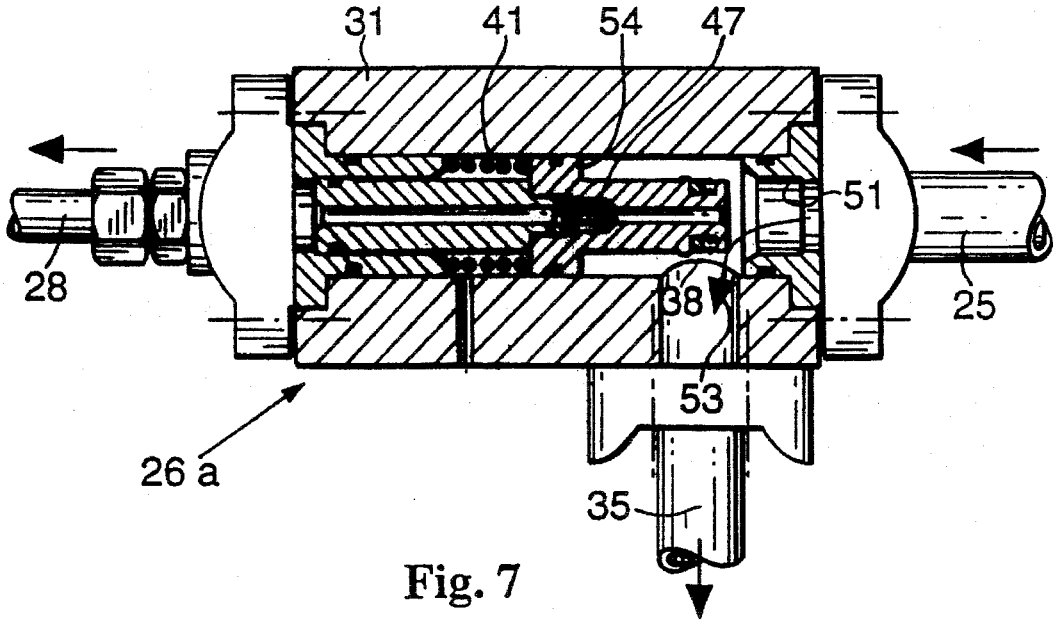
Fig. 7

INSTALLATION FOR FIGHTING FIRE

The present invention relates to an installation for fighting fire, with at least one releasing means reacting under the influence of an indication of fire, to initiate a fire extinguishing process.

In known equipment of this kind, especially in public spaces, such as restaurants, that particular individual sprinkler, the release ampoule or the like of which becomes under influence of hot air or smoke, has been activated. It has hereby been presumed that hot air or smoke rises practically in the vertical direction.

In reality, e.g. ventilation causes the hot air or the smoke to move obliquely upwards, for which reason often such a sprinkler which is not positioned right above the fire, has been activated. An active sprinkler in "wrong" position may lead to a general cooling in the room, with the result that the "correctly" positioned sprinkler above that fire remains inactive in spite of the fire developing.

One object of the present invention is to provide a new fire-fighting istallation which eliminates the said problem.

The equipment according to the present invention is mainly characterized in that said releasing means is arranged to activate a group of spray heads.

In a preferred embodiment of the invention, said group of spray heads forms a part of a larger system of individually activatable spray head groups. Preferably the groups of spray heads are aranged to overlap each other by means of the respective border spray heads which are activatable alternatively within either respective group. This can be achieved e.g. by means of check valves at the border spray heads, which valves prevent extinguishing liquid from flowing from an activated group of spray heads to an inactivated group of spray heads.

The groups of spray heads can be positioned near or at the ceiling of a restaurant room, whereat one or several releasing spray heads can be provided for each group of spray heads and the releasing spray head or heads are preferably arranged to distribute extinguishing liquid directly to the other spray heads in the respective group.

The spray heads, their individual nozzles and the mutual arrangement of the nozzles are preferably made according to what is presented in the international patent applications PCT/FI92/00060, PCT/FI92/00155 and PCT/FI92/00156, to produce a fog-like spray of a high operating pressure and having a good penetration power.

By a fog-like spray is meant a spray of small droplets having a diameter typically 30 to 100 microns and preferably set in a strong whirling motion. By a high operating pressure is here in general meant from about 100 bar up to about 300 bar, as compared to an operating pressure of generally 2 to 10 bar in conventional sprinkler installations, which produce a rain-like spray. It shall be noted, however, that the values given above are not absolute; definite limiting values are difficult to present.

One important advantage of a fog-like spray in connection with a so-called group activation, as here presented, is that a curtain effect is obtained, i.e. that the area and space covered by an activated group of spray heads will be separated from the rest of the larger space, so that most of the fog-like spray remains in the fire area. Further, that air which is sucked into the fire from the sides brings "fog" into the fire, and the smoke generated by the fire becomes at least partially washed.

In a further preferred embodiment of the invention, at least one release means is positioned in an upper region of the respective space and at least one spray head governed by the release means is positioned in the floor or in a wall of the respective space. Especially in this embodiment, the release means may, instead of a spray head, be e.g. a smoke detector which gives a signal to e.g. a solenoid valve which in turn activates a group of spray heads. Thus, the extinguishing liquid need not necessarily be distributed to the respective group of spray heads through the releasing means itself, such as a spray head, but electrical or electronical known activating equipment may be employed, alternatively.

A releasing spray head can be arranged to distribute extinguishing liquid to one or a group of secondary spray heads directly or indirectly, through a guide or governor valve. Preferred embodiments of such valves are defined in claims 9–12.

The invention shall in the following be described in more detail, with reference to exemplifying preferred embodiments shown in the attached drawing.

FIG. 6A shows a longitudinal section of a first embodiment of a guide valve, in inactivated state, suitable for use e.g. in the arrangement of FIGS. 4 and 5.

FIG. 6B shows an enlarged portion of FIG. 6A.

FIG. 7 shows the same valve in activated state.

Figure 1:
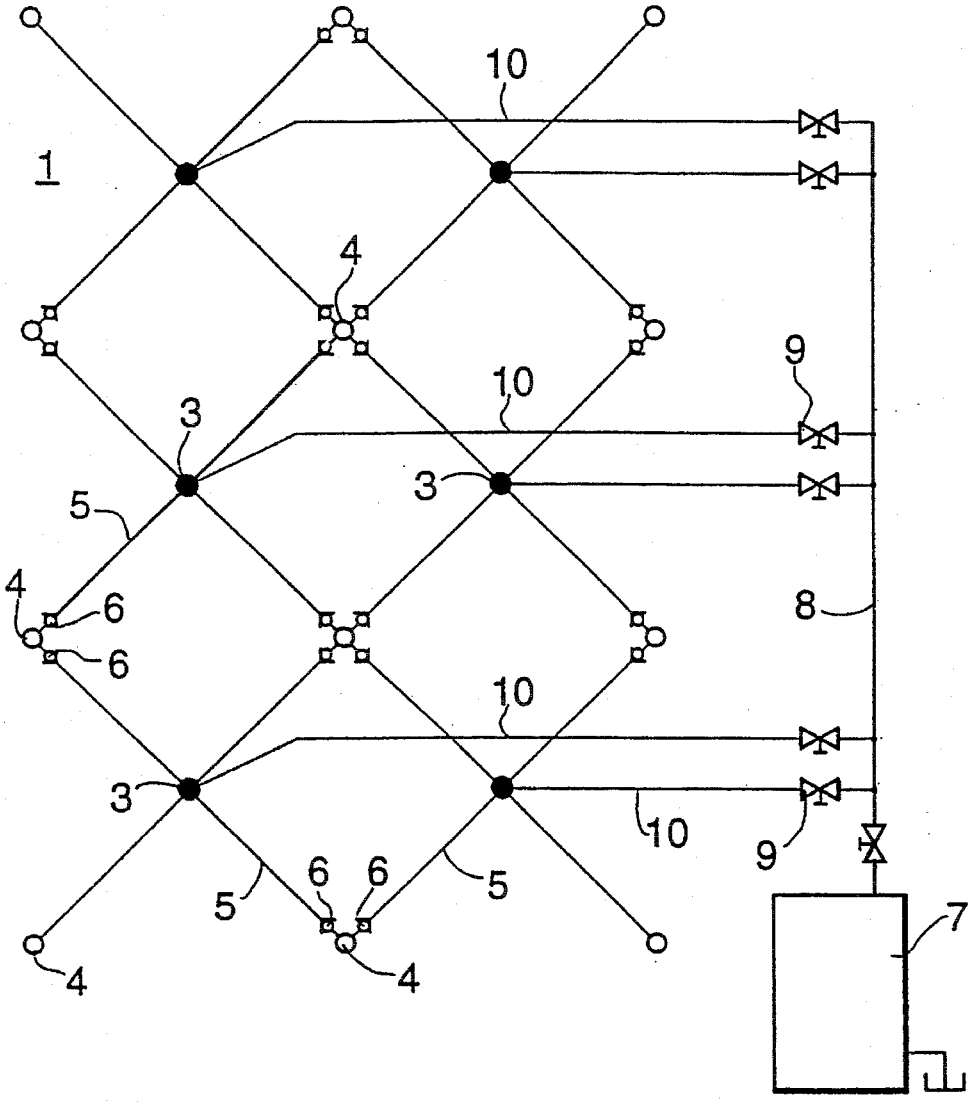
FIG. 1 shows an example of an arrangement of spray heads in a ceiling of a relatively large space, e.g. a restaurant room, seen from above.
Figure 2:
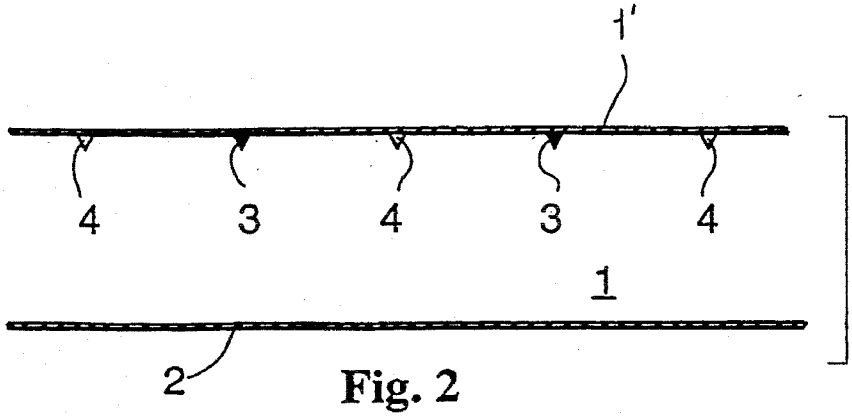
FIG. 2 is a side view of the same space.

In FIGS. 1 and 2, the reference numeral 1 indicates a space, such as a restaurant room. The reference numeral 2 indicates the floor of the space, in FIG. 2.

A number of releasing, or activating or governing spray heads are designated 3 and each such spray head 3 is in connection with e.g. four surrounding spray heads 4, through conduits 5.The releasing spray heads 3 can also be called primary spray heads, whereas the spray heads 4 can be called secondary spray heads. In the connections 5 between such secondary spray heads 4 which are connected to more than one activating spray head 3, is arranged a check valve 6, respectively. The spray heads 3 and 4 are preferably positioned in the ceiling of the room, as shown in FIG. 2.

When an activating spray head 3 has been released because of a fire nearby, a high pressure pump unit 7 drives liquid via a main line 8 and the respective feed line 10, including a governor valve 9, to the respective released spray head 3 and from that further to four surrounding secondary spray heads 4, in the embodiment of FIG. 1. One released spray head 3 thus effects extinguishing within a relatively large surrounding area. The check valves 6 prevent the exinguishing liquid from spreading to spray heads 4 belonging to a neighboring group.

Figure 3:
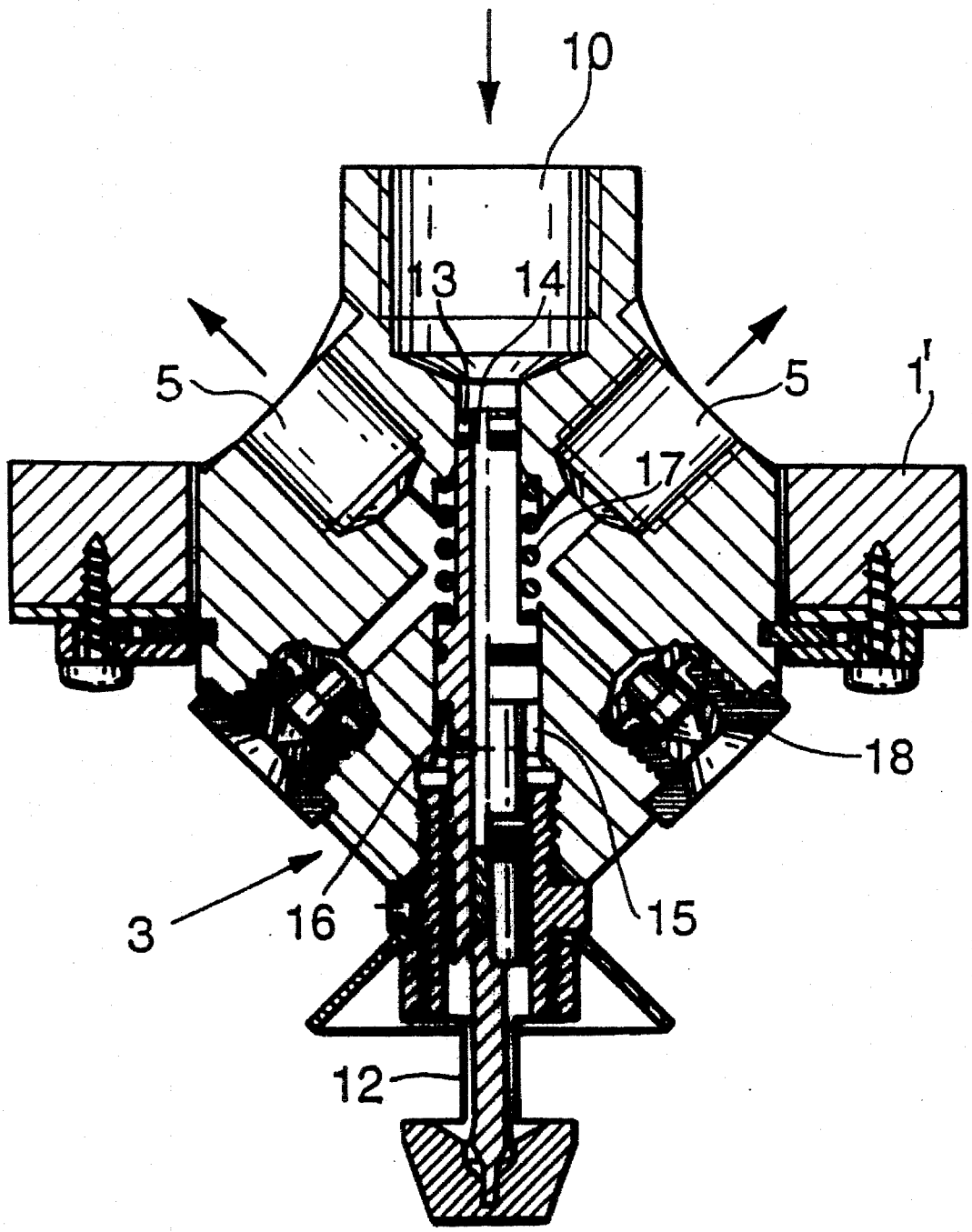
FIG. 3 shows a longitudinal section of a release spray head, suitable for use in the arrangement of FIGS. 1 and 2.

A preferred embodiment of a release spray head 3, positioned in the ceiling 1 in FIG. 1, is shown in FIG. 3. Reference numeral 10 indicates a liquid inlet and connections to secondary spray heads 4 are indicated by 5. A release ampoule is indicated by 12.

The spray head 3 is preferably of a structure described in the international patent application PCT/FI92/00060 (WO 92/15370), with a spring loaded axially movable spindle 13 having an axial channel 14 in connection with an annular space 15 with an axial, pressure compensating end surface 16 which makes it possible to utilize a drive pressure of extraordinary magnitude, even up to about 300 bar, in the installation.

FIG. 3 shows the spray head in an inactivated state of rest. Upon the ampoule 12 being released, e.g. by melting or crushing, the spring 17 presses the spindle 13 downwards in the figure, whereat connection is opened from the inlet 10 to the conduits 5 and to the obliquely downwards directed nozzles 18 of the spray head 3. The nozzles 18 are preferably of a structure and in a mutual arrangement as described in the international patent applications PCT/FI92/00155 and PCT/FI92/00156. The secondary spay heads are preferably of the same kind but need no spindle like the activating spray head 3.

In addition to, or instead of the secondary spray heads 4 positioned in the ceiling, spray heads can be positioned in the floor. Such floor spray heads are preferably of the kind described in the international patent application PCT/FI92/00213. The releasing and activating spray heads 3 can hereby be replaced by release means only, which govern valves for the floor spray heads.

Figure 4:
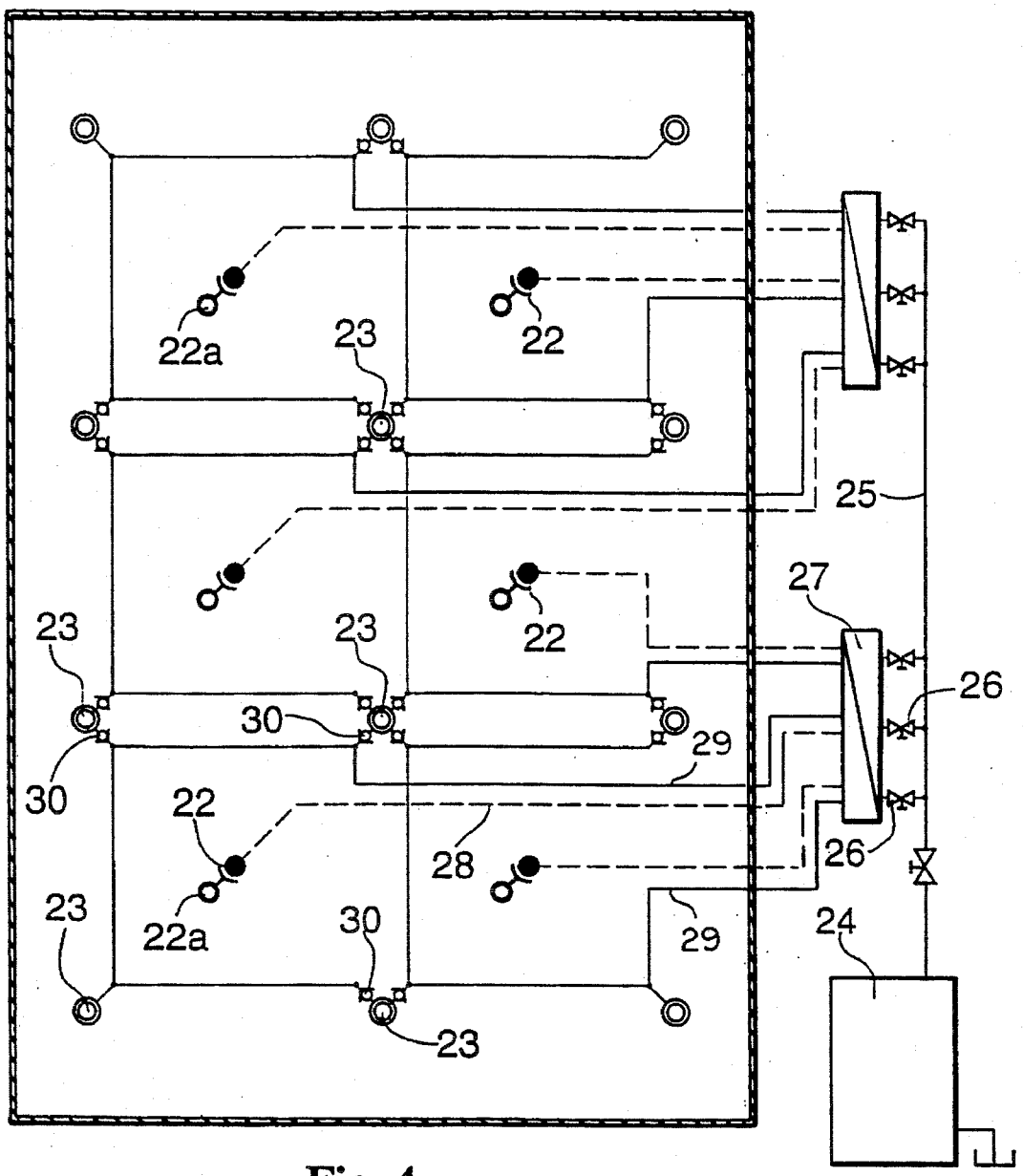
FIG. 4 shows an example of an arrangement of spray heads in the ceiling and in the floor of a smaller room, such as a computer room, seen from above.
Figure 5:
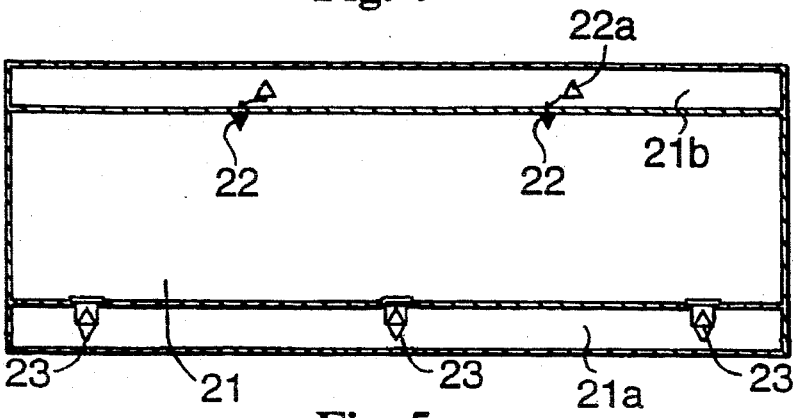
FIG. 5 is a side view of the room of FIG. 4.

A preferred embodiment of the foregoing alternative arrangement is shown in FIGS. 4 and 5, where the reference numeral 21 indicates a relatively small room, such as a computer room. Spray heads at the ceiling are indicated by 22 and spray heads positioned in the floor are indicated by 23.

In computer rooms it is of advantage to place necessary, often extensive cable bundles in a channel under the floor. Such a channel is indicated by 21*a* in FIG. 5. As suggested in the patent application PCT/FI92/00213, the spray heads 23 are preferably arranged to spray a water fog into the cable channel 21*a* as well, to ensure that a fire does not spread through the channel and is not capable of damaging cables placed in the channel. A similar channel, e.g. for ventilation, is often present in the ceiling, as indicated by 21*b*, and the releasing spray heads 22 are preferably made to deliver liquid to spray heads 22*a* in the channel 21*b*.

A pump unit for extinguishing liquid is indicated by 24, the outgoing main line thereof is indicated by 25, and individually operable guide valves are indicated by 26. The guide valves can be incorporated in blocks 27. Feed lines to the ceiling spray heads 22 and to the floor spray heads 23 are indicated by 28 and 29, respectively. The reference numeral 30 indicates check valves like the valves 6 in FIG. 1. Alternatively to what is shown in FIGS. 4 and 5, spray heads can be positioned on the wall instead of in the floor.

FIGS. 6 and 7 show a first embodiment of a guide valve 26*a* in detail. The valve comprises a body 31 with an inlet head 32 from the pump main line 25 and an outlet head 34 mounted in the opposite end, leading to a primary, activating spray head, and with an outlet 35, near the inlet 32, to secondary spray heads.

A spindle 36 is slidably arranged in the valve body 31, one end portion of the spindle extending into the inlet head 32 and the other end portion extending into the outlet head 33. Spindle seals in relation to the inlet head 32 and in relation to the outlet head 33 are indicated by 37 and 38, respectively. The spindle 36 has a piston 39 approximately at its mid-portion, with a seal 40 against the valve body 31. Between the spindle piston 39 and the outlet head 33 is arranged a spring 41, the spring space 42 being in connection to the atmosphere through at least one bore 43 in the wall of the valve body near the inner end of the head 33. an axial channel 44 extends from end to end through the spindle 36 and the end surfaces 45 and 46 of the spindle are of equal area.

In the axial channel 44 is arranged a check valve 47 with a small axial aperture 48, a spring 49 and a seal 50.

FIG. 6 shows the guide valve in inactivated state. The inlet 32, the outlet 34 to at least one closed primary spray head and the axial channel 44 of the spindle 36 are filled with liquid. Since the end faces 45 and 46 of the spindle have equal areas, the forces acting on the end faces due to the liquid pressure are in balance and the spring 41 presses the piston 39 rightwards in FIG. 6, with the spindle end to abutment against a stop 51 at the inlet 32. There is no connection from the inlet 32 to the outlet 35 leading to secondary spray heads.

When a primary spray head, connected to the outlet 34, is released, a liquid flow under high pressure starts through the valve and thereby through the axial channel 44, including the check valve 47. The pressure fall over the check valve 47, especially over the aperture 48 to begin with, and over the spindle 36 on the whole is great enough to force the spindle 36 to the position shown in FIG. 7, with the end face 45 against a stop 52 in the head 33 near the outlet 34 and open a diect connection from the inlet 32 to the outlet 35, as indicated by arrow 53. With this connection open, the liquid pressure acts on the end face 54 of the piston 39 and ensures that the spindle remains in the position of FIG. 7.

Figure 8:
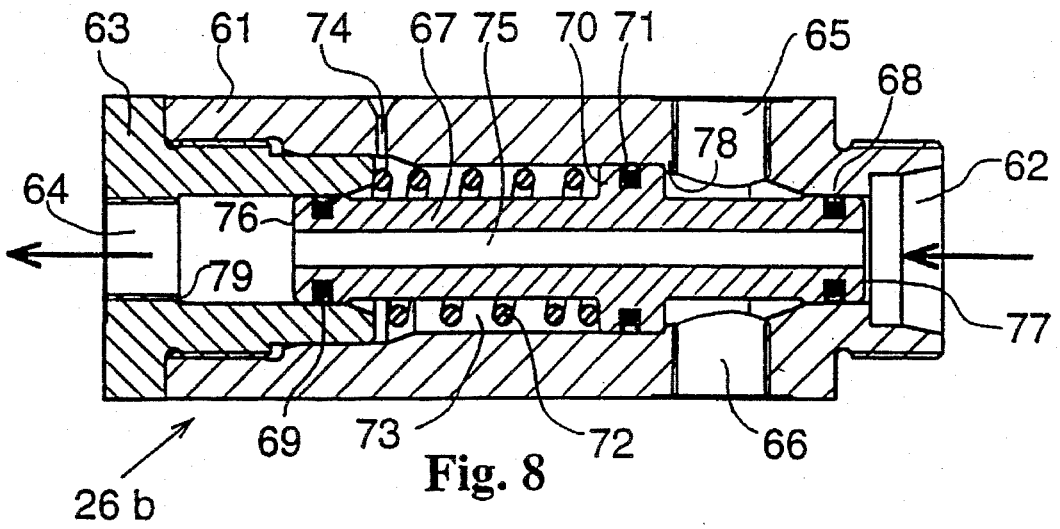
FIG. 8 shows a longitudinal section of a second embodiment of a guide valve, in inactivated state, suitable for use e.g. in the arrangement of FIGS. 4 and 5.
Figure 9:
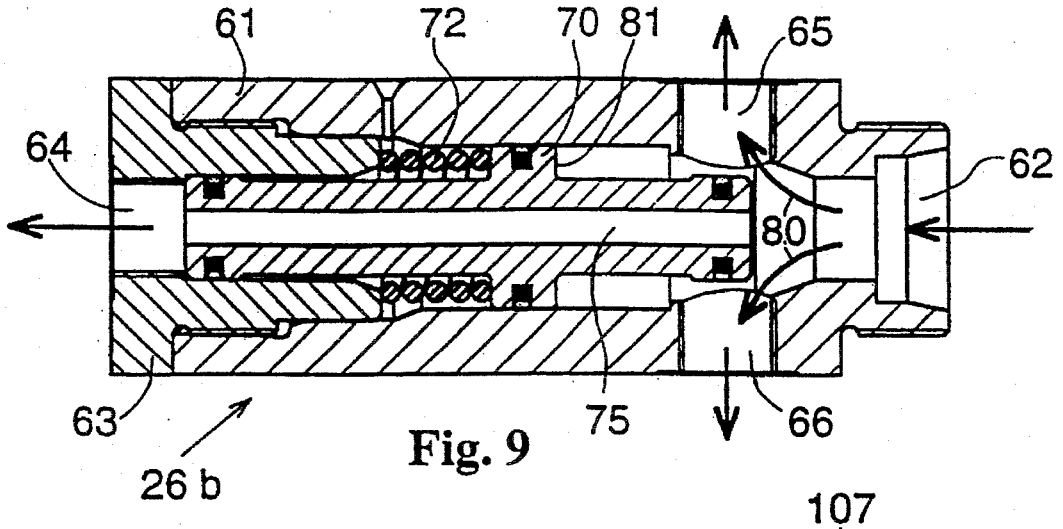
FIG. 9 shows the valve of FIG. 8 in activated state.
Figure 10:
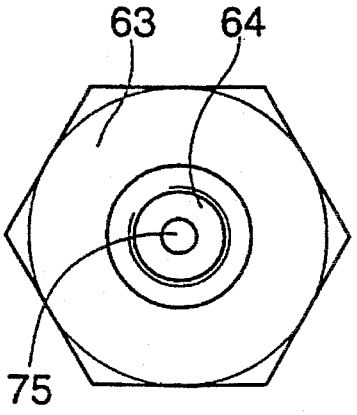
FIG. 10 is an end view of the valve of FIGS. 8 and 9.

FIGS. 8–10 show a second, preferred embodiment of a guide valve 26*b* in detail. The valve comprises a body 61 with an inlet 62 from the pump main line and with a head 63 mounted in the opposite end, forming an outlet 64 leading to a primary, activating spray head, and with two outlets 65 and 66, near the inlet 62, to secondary spray heads.

A spindle 67 is slidably arranged in the valve body 61, one end portion of the spindle extending into the head 63. Spindle seals in relation to the inlet portion of the valve body 61 and in relation to the head 63 are indicated by 68 and 69, respectively. The spindle 67 has a piston 70 approximately at its mid-portion, with a seal 71 against the valve body 61. Between the spindle piston 70 and the head 63 is arranged a spring 72, the spring space 73 being in connection to the atmosphere through at least one bore 74 in the wall of the valve body near the inner end of the head 63. An axial channel 75 extends the from end to end through the spindle 67 and the end surfaces 76 and 77 of the spindle are of equal area.

FIG. 8 shows the guide valve in inactivated state. The inlet 62, the outlet 64 to at least one closed primary spray head and the axial channel 75 of the spindle 67 are filled with liquid. Since the end faces 76 and 77 of the spindle have equal areas, the forces acting on the end faces due to the liquid pressure are in balance and the spring 72 presses the piston 70 against a stop 78 near the outlets 65 and 66 to secondary spray heads. There is no connection from the "wet" inlet 62 to the outlets 65 and 66 which are "dry".

When at least one primary spray head, connected to the outlet 64, is released, a forceful liquid flow starts through the valve and thereby through the axial channel 75 of the spindle 67. The channel 75 can be made so narrow that the pressure fall from end to end is great enough to force the spindle 67 to the position shown in FIG. 9 with the end face 76 against a stop 79 in the head 63 near the outlet 64 and open direct connections from the inlet 62 to the outlets 65 and 66, as indicated by arrows 80.

In a preferred embodiment, a branch line is connected from the respective primary spray head to either one of the "dry" outlets 65 and 66. When the primary spray head is released, pressurized liquid flows through the branch line to act on the annular end 81 of the piston 70, facing to the right in FIGS. 9 and 10, with a great force. The pressure fall over the spindle 67 is then of little importance, i.e. the channel 75 can be made wider and a stronger spring 72 can be used.

Figure 11:
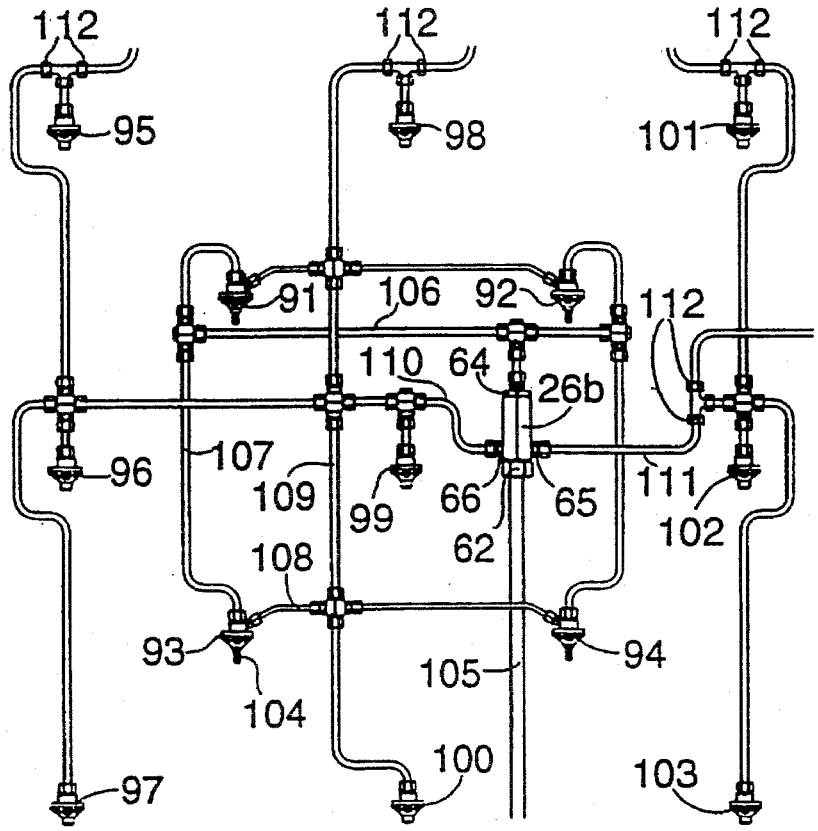
FIG. 11 illustrates the operating principle of the guide valve of FIGS. 8–10, for a group of spray heads.

FIG. 11 illustrates one example of this preferred embodiment.

In FIG. 11, one guide valve **26*b* serves four primary spray heads 91–94, connected to the "wet" outlet 64 of the valve 26*b*, and nine secondary spray heads 95–103 connected to the "dry" outlets 65 and 66 of the valve 26*b***.

It is now assumed, that the primary spray head 93 is activated, i.e. its release ampoule, or bulb 104 is released under the influence of e.g. hot air rising from a fire seat. Liquid under a high pressure starts flowing from the pump feed line 105 through the valve inlet 62, the axial channel 75 of the spindle 67 therein, the outlet 64 and the lines 106 and 107 to the primary spray head 93. A part of the liquid flows further through a branch line 108, connected to the primary spray head 93, and through the lines 109 and 110 to the formerly "dry" outlet 66 and presses the spindle 67 of the valve **26*b* to the position shown in FIG. 10. Thereafter liquid under high pressure flows diectly from the pump feed line 105 through the outlets 65 and 66 and the lines 110 and 111 to all secondary spray heads 95–103**.

The function is the same if two or more primary spray heads are activated. The activating liquid flow from the primary spray head 93 to the guide valve **26*b* also goes to the secondary spray heads but the flow resistance of these are much greater than the flow resistance in the path to the valve 26*b*. Check valves 112 cut the connections from the secondary spray heads 95, 98, 101 and 102** to adjacent similar groups of spray heads.

Figure 12:
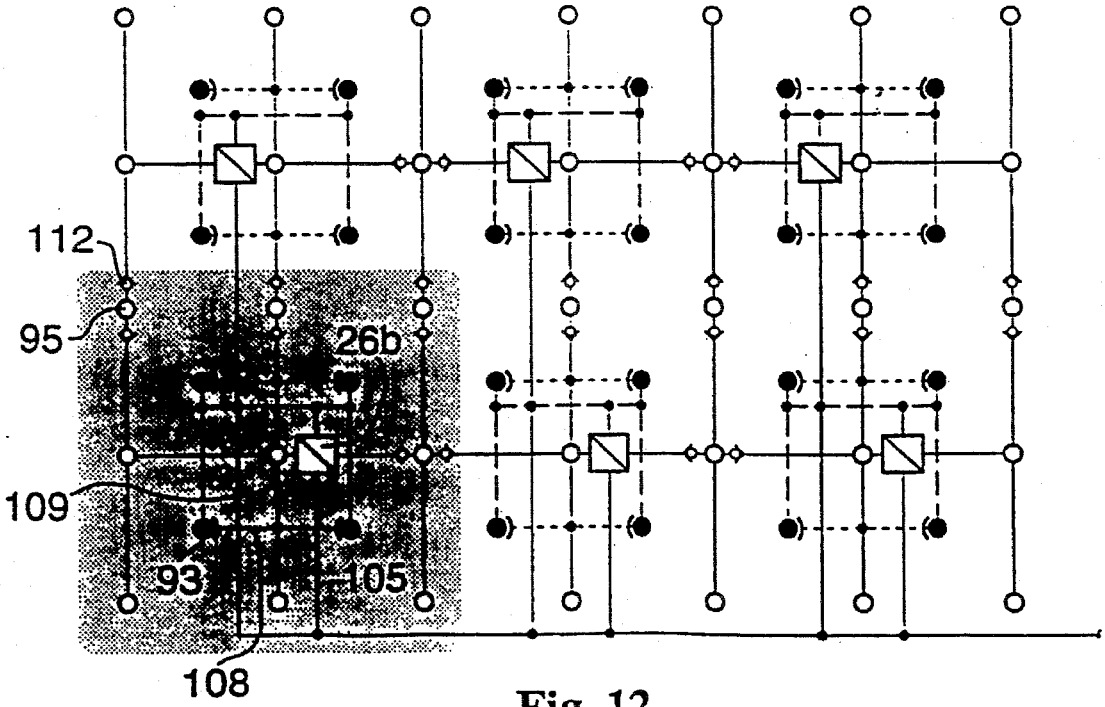
FIG. 12 shows the spray head group of FIG. 11 in relation to a larger installation.

The spray head group shown in FIG. 11 is preferably a part of a larger system, e.g. in the way shown in FIG. 12, where the area covered by the group of FIG. 11 is indicated by grey colour. The reference numerals in FIG. 12 indicate the same as in FIG. 11. FIG. 11 may give the impression that e.g. the spray heads 95, 96 and 97 are positioned above each other; the spray heads have been drawn in this direction for the purpose of showing the general structure of the spray heads, only, in reality they are directed into the drawing plane, as will be understood from FIG. 12 also. The spray heads 95–103, or some of them, may of course alternatively be positioned in a floor.

As earlier mentioned, the primary spray heads are preferably made as presented in the international patent application PCT/FI92/00060 and both the primary spray heads and the secondary spray heads are preferably made as presented in the international patent applications PCT/FI92/00155 and PCT/FI92/00156 to produce fog-like sprays with a good penetration power.

A spray head group like the one shown in FIGS. 11 and 12 is very effective for extinguishing a fire, partly because it is fast-responsive but also because the outer secondary spray heads of the group form, when activated, "curtains" of fog spray which divide the respective group area from the rest of a larger space, such as a restaurant room, i.e. most of the fog spray remains within the area covered by the activated spray head group.

Figure 13:
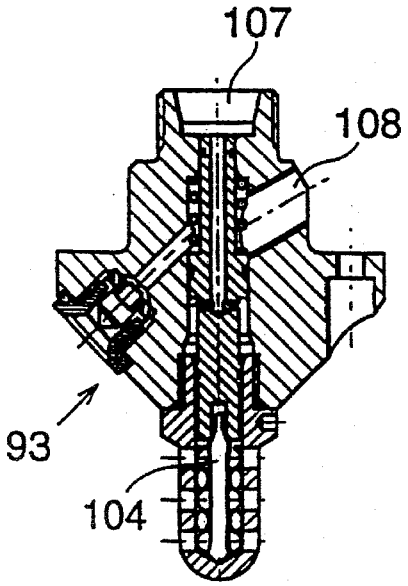
FIG. 13 shows a longitudinal section of a release spray head suitable for use e.g. in the arrangements of FIGS. 4 and 5 and of FIGS. 11 and 12.

FIG. 13 shows in section a releasing spray head 93. It has a spindle structure similar to the one described in connection with FIG. 3, so that a high pressure in the inlet line 107 does not prematurely damage or crush the release ampoule 104. When the ampoule 104 is weakened and releases the spindle structure to move downwards in the figure, the incoming from the line 107 has access to both the nozzles of the spray head 93 and to a branch line 108 which, as described in the foregoing, can lead to other spray heads or to a governing valve.

A similar spray head 93 can preferably be used in the arrangement shown in FIGS. 4 and 5, for the schematically drawn releasing spray heads 22. The schematically drawn spray heads **22*a* in FIGS. 4 and 5 can be of the same kind as the spray heads 95–103 in FIG. 11**.

Instead of, or in addition to, a pump unit as described in the foregoing, the drive unit for the extinguishing liquid can comprise hydraulic accumulators, preferably arranged as presented in the international patent application PCT/FI92/00193 or in the Finnish patent application 924752.

I claim:

1. An installation for fighting fire, comprising:

first and second releasing means reacting under an influence of an indication of fire respectively for activating first and second groups of spray heads (4;23;95–103), said first and second groups of spray heads overlapping each other at border spray heads (95;98;101;102), said border spray heads being activatable alternatively by either of said first and second releasing means, wherein check valves (6;30;112) at said border spray heads (95;98;101;102) prevent extinguishing liquid from flowing from an activated one of said first and second groups of spray heads to an inactivated one of said groups of spray heads.

2. The installation according to claim 1 in combination with a room to be protected, wherein said releasing means (3;91–94) and at least one of said groups of spray heads (4;95–103) are in an upper region of said room.

3. The installation according to claim 1 in combination with a space to be protected, wherein said first releasing means (22) is positioned in an upper region of said space and at least one spray head (23) of said first group of spray heads is positioned in a floor of said space.

4. The installation according to claim 1, wherein said first releasing means is a spray head (22; 91–94) connected to a guide valve (**26*a*;26*b*), said guide valve being for distributing extinguishing liquid to said first group of spray heads (23;95–103**).

5. The installation according to claim 4, wherein said guide valve (**26*a*;26*b***) comprises:

a valve body (31;61) with an inlet (32;62) connected to a liquid feed line (25;105), an outlet (34;64) connected to said inlet and to at least one releasing spray head (22;91–94), and at least one second outlet (35;65,66) connected to said inlet and said first group of spray heads (23;95–103); and a spindle (36;67) movable in the valve body in sealed relation thereto from a first position closing connection from said inlet (32,62) to said at least one second outlet to a second position opening connection from said valve inlet (32;62) to said at least one second outlet;

said spindle (36;67) having end faces (45,46;76,77) of equal area respectively facing towards said valve inlet (32;62) and said outlet (34;64) to said at least one releasing spray head (22;91–94) and an axial channel (44;75) extending between said end faces (45,46;76, 77), and movement from said first position to said second position being at least partially effected by a pressure fall over the axial channel (44;75) when extinguishing liquid flows through said channel to said releasing spray head (22;91–94).

6. The installation according to claim 5, wherein said spindle (36;67) comprises a piston portion (39;170) in sealed relation to said valve body (31;61), a spring (41;72) acting on an end face of said piston for keeping said spindle in said first position when there is no liquid flow through said axial channel (44;75), a second end face of said piston (54;81) being under influence of pressure in said at least one outlet when said spindle is in said second position (35;65,66).

7. The installation according to claim 6, wherein a throttled valve element (47) is provided in said axial channel (44).

8. The installation according to claim 6, wherein a branch line (108) is connected from said at least one releasing spray head (93) to said at least one second outlet (66) of said value body.

9. An installation for fighting fire comprising:

a group of spray heads, and at least one releasing means (3;22;91–94) reacting under an influence of an indication of fire for activating said group of spray heads (4;23;95–103), wherein said releasing means is a spray head (3) which includes means for distributing extinguishing liquid directly to said group of spray heads (4).

* * * * *